US008718296B2

(12) United States Patent
Chang

(10) Patent No.: US 8,718,296 B2
(45) Date of Patent: May 6, 2014

(54) PORTABLE ELECTRONIC DEVICE HAVING UNIVERSAL EARPHONE JACK

(75) Inventor: Jo-Chien Chang, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 171 days.

(21) Appl. No.: 13/151,262

(22) Filed: Jun. 1, 2011

(65) Prior Publication Data

US 2012/0104870 A1 May 3, 2012

(30) Foreign Application Priority Data

Oct. 29, 2010 (TW) ..... 99137074 A

(51) Int. Cl.
*H04R 5/033* (2006.01)

(52) U.S. Cl.
USPC ..... 381/74; 381/384

(58) Field of Classification Search
None
See application file for complete search history.

(56) References Cited

U.S. PATENT DOCUMENTS 7,912,501 B2 * 3/2011 Johnson et al. ..... 455/556.1
2011/0135109 A1 * 6/2011 Park et al. ..... 381/74

* cited by examiner

*Primary Examiner* — Duc Nguyen
*Assistant Examiner* — Anita Masson
(74) *Attorney, Agent, or Firm* — Novak Druce Connolly Bove + Quigg LLP

(57) ABSTRACT

A portable electronic device includes an earphone jack capable of receiving different types of earphone plugs, a switch, a detecting terminal, and a controlling terminal. The switch is connected to the earphone jack, and capable of switching between a first state and a second state. The detecting terminal is connected to the earphone jack by the switch, and capable of detecting the type of the earphone plug received in the earphone jack. The detecting terminal is connected to the earphone jack by the switch, and capable of detecting the type of the earphone plug received in the earphone jack. The controlling terminal is connected to the switch, and switches the switch to either the first state or the second state according to the type of the earphone plug.

15 Claims, 5 Drawing Sheets

PORTABLE ELECTRONIC DEVICE HAVING UNIVERSAL EARPHONE JACK

BACKGROUND

1. Technical Field

The disclosure generally relates to portable electronic devices, and particularly to a portable electronic device having an earphone jack, which can receive different types of earphone plugs.

2. Description of Related Art

A three pin earphone plug usually includes a first contact portion, a second contact portion, and a third contact portion orderly formed thereon. Referring to the three pin earphone plug shown in FIG. 3, the first contact portion is a left channel point REC_L. The second contact portion is a right channel point REC_R. The third contact portion is a ground point GND. A four pin earphone plug usually includes a first contact portion, a second contact portion, and a third contact portion orderly formed thereon. Referring to a first type of four pin earphone plug shown in FIG. 4, the first contact portion is a left channel point REC_L. The second contact portion is a right channel point REC_R. The third contact portion is a microphone channel point MIC. The fourth contact portion is a ground point GND. Referring to a second type of four pin earphone plug shown in FIG. 5, the first contact portion is a left channel point REC_L. The second contact portion is a right channel point REC_R. The third contact portion is a ground point GND. The fourth contact portion is a microphone channel point MIC. A related portable electronic device usually can use only one of the three pin earphone plug, the first type of four pin earphone plug, or the second type of four pin earphone plug, and lacks flexibility.

Therefore, there is room for improvement within the art.

DETAILED DESCRIPTION

Figure 1:
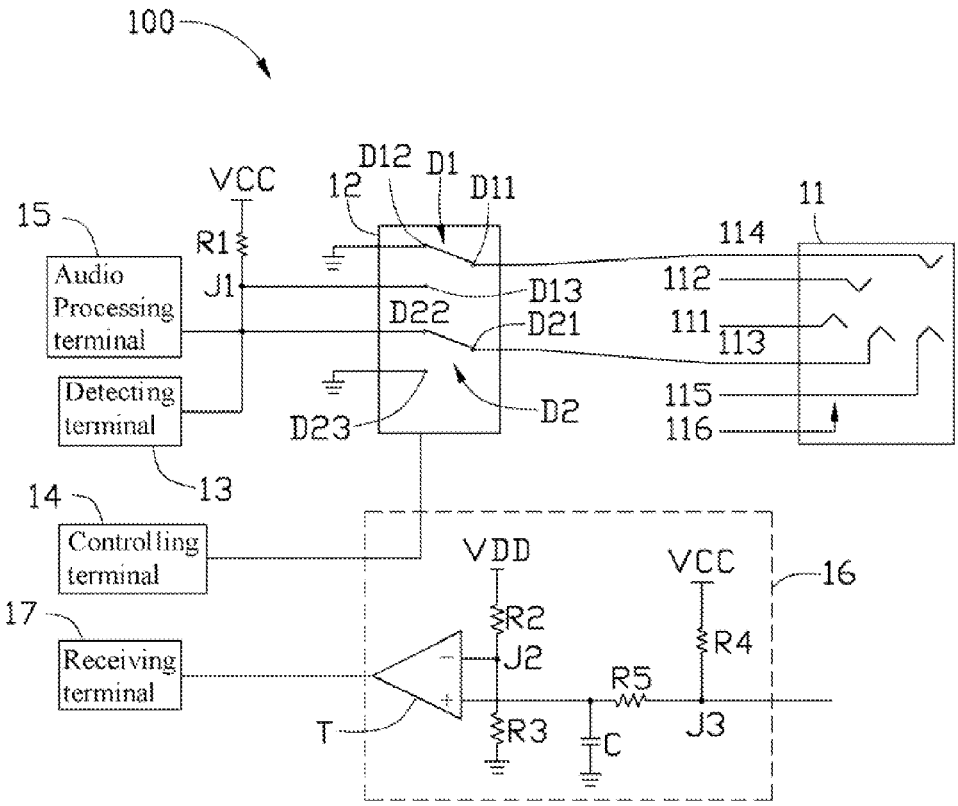
FIG. 1 is a circuit diagram of the portable electronic device, according to an exemplary embodiment, receiving a three pin earphone plug and a first type of four pin earphone plug.

FIG. 1 shows a circuit diagram of a portable electronic device 100, according to an exemplary embodiment. The portable electronic device 100 includes an earphone jack 11, a switch 12, a detecting terminal 13, a controlling terminal 14, and an audio processing terminal 15.

Figure 3:
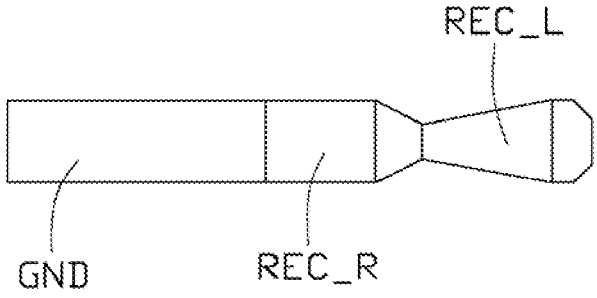
FIG. 3 (RELATED ART)
FIG. 3 is a schematic view of the three pin earphone plug of FIG. 1.

The earphone jack 11 includes a first contact 111, a second contact 112, a third contact 113, a fourth contact 114, a fifth contact 115 and a sixth contact 116. The earphone jack 11 can receive different types of earphone plugs. When a three pin earphone plug shown in FIG. 3 is received in the earphone jack 11, the first contact 111, and the second contact112 are respectively connected to the left channel point REC_L, and the right channel point REC_R, and the third contact 113 and the fourth contact 114 are both connected to the ground point GND.

Figure 4:
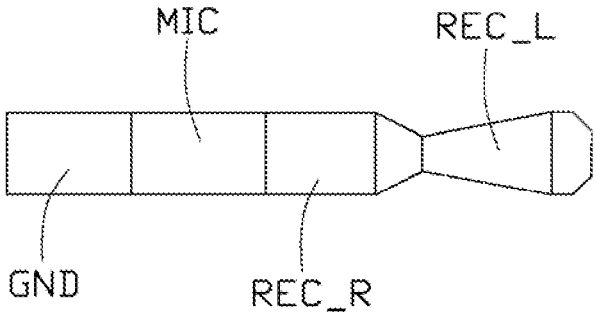
FIG. 4 (RELATED ART)
FIG. 4 is a schematic view of the first type of four pin earphone plug of FIG. 1.

When a first type of four pin earphone plug shown in FIG. 4 is received in the earphone jack 11, the first contact 111, the second contact112, the third contact 113, and the fourth contact 114 are respectively connected to the left channel point REC_L, the right channel point REC_R, the microphone point MIC, and the ground point GND.

Figure 5:
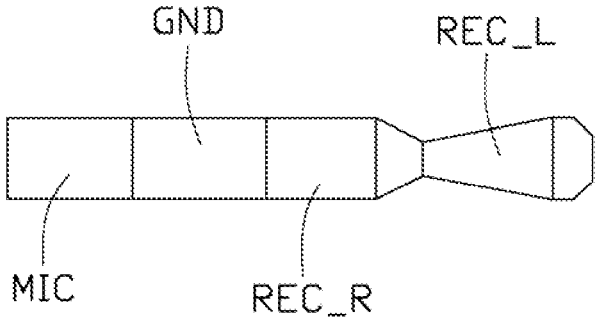
FIG. 5 (RELATED ART)
FIG. 5 is a schematic view of the second type of four pin earphone plug of FIG. 2.

When a second type of four pin earphone plug shown in FIG. 5 is received in the earphone jack 11, the first contact 111, the second contact112, the third contact 113, and the fourth contact 114 are respectively connected to the left channel point REC_L, the right channel point REC_R, the ground point GND, and the microphone point MIC. Furthermore, the fifth contact 115 is grounded.

Figure 2:
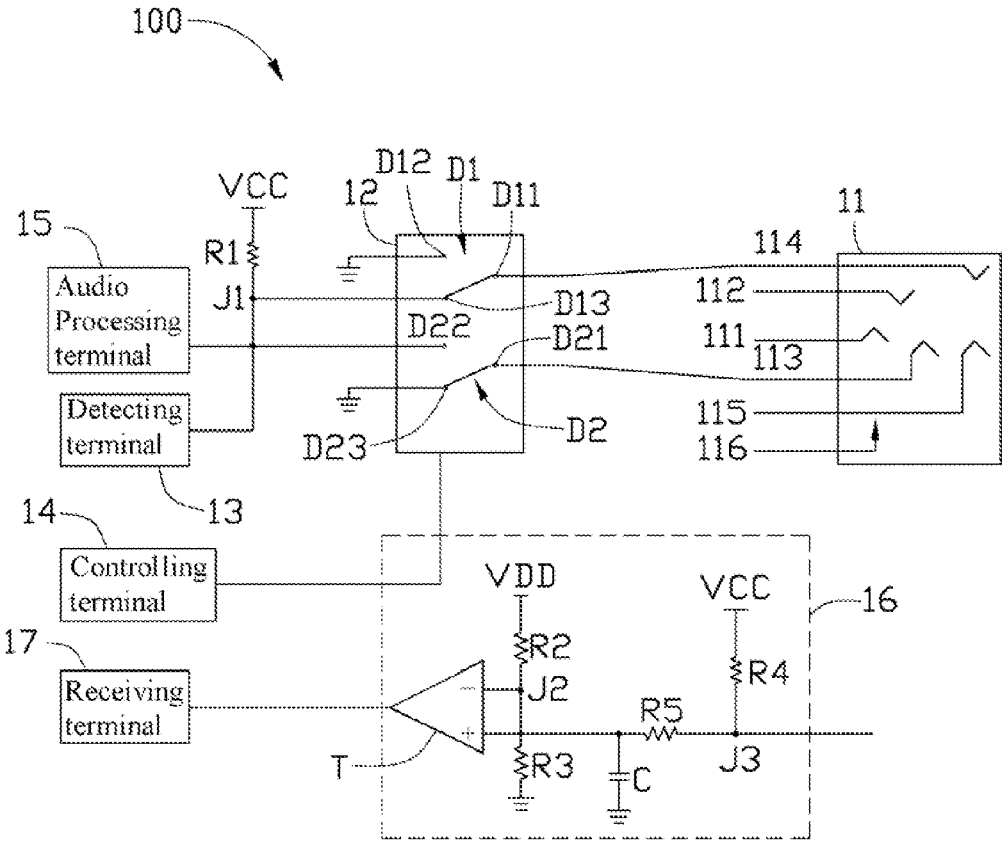
FIG. 2 is similar to FIG. 1, but received a second type of four pin earphone plug.

Also referring to FIG. 2, the switch 12 includes a first switch D1 and a second switch D2. The first switch D1 and the second switch D2 are both single pole double throw switches. The first switch D1 includes a first movable contact D11, a first fixed contact D12, and a second fixed contact D13. The second switch D2 includes a second movable contact D21, a third fixed contact D22, and a fourth fixed contact D23. The switch 12 can switch between a first state and a second state. In the first state, the first movable contact D11 and the second movable contact D21 are respectively connected to the first fixed contact D12 and the third fixed contact D22. In the second state, the first movable contact D11 and the second movable contact D21 are respectively connected to the second fixed contact D13 and the fourth fixed contact D23.

The first movable contact D11 and the second movable contact D21 are respectively connected to the fourth contact 114 and the third contact 113. The first fixed contact D12 and the fourth fixed contact D23 are both grounded. The second fixed contact D13 and the third fixed contact D21 are both connected to a first power VCC by a first resistor R1, and form a first node J1.

The detecting terminal 13 is connected to the first node J1 and configured for detecting the type of the earphone plug received in the earphone jack 11 according to a voltage of the third contact 113 or the fourth contact 114 through the switch 12. Particularly, when the three pin earphone plug shown in FIG. 3 is received in the earphone jack 11, the third contact 113 and the fourth contact 114 are both connected to the ground point GND, and a voltage difference between the third contact 113 and the fourth contact 114 is less than a predetermined voltage, such as 0.3 V. Therefore, if the voltage of the first node J1 is less than the predetermined voltage, the detecting terminal 13 detects that the type of the earphone plug received in the earphone jack 11 is the three pin earphone plug.

When the first type of four pin earphone plug is received in the earphone jack 11, the third contact 113 and the fourth contact 114 are respectively connected to the microphone point MIC and the ground point GND. The microphone point MIC equals to a field effect transistor and the fourth contact 114 is grounded, and the voltage of the microphone point MIC satisfies a bias voltage range, such as 0.3V<a detected voltage<0.8V. Therefore, if the voltage of the first node J1 satisfies the bias voltage range, the detecting terminal 13 detects that the type of the earphone plug received in the earphone jack 11 is the first type of the four pin earphone plug.

If the voltage of the node J1 does not satisfy the bias voltage range and also not less than the predetermined voltage, the detecting terminal 12 detects that the type of the earphone plug received in the earphone jack 11 is the second type of the four pin earphone plug.

The controlling terminal 14 is connected to the switch 12. The controlling terminal 14 switches the switch 12 to a corresponding state (i.e. the first state or the second state) according to the type of the earphone plug received in the earphone jack 11.

An end of the audio processing terminal 15 is connected to the first node J1. Another end of the audio processing terminal 15 is connected to an audio processing circuit (not shown) of the portable electronic device 100. The audio processing terminal 15 is used to receive audio by the microphone point MIC of the first type of the four pin earphone plug or the second type of the four pin earphone plug, and transfer the received audio to the audio processing circuit. The audio processing circuit is used to receive and process audio from the audio processing terminal 15.

The portable electronic device 100 further includes a determination circuit 16 and a receiving terminal 17. The determination circuit 16 includes a chipset T. A negative electrode of the chipset T is connected to a second power VDD by a second resistor R2, and forms a second node J2. The second node J2 is grounded by a third resistor R3. A positive electrode of the chipset T is connected to the first power VCC by a fourth resistor R4 and a fifth resistor R5 in series, and forms a third node J3. The third node J3 is connected to the sixth contact 116. The positive electrode of the chipset T is grounded by a capacitor C. The output terminal of the chipset T is connected to the receiving terminal 17. The voltage of the second node J2 is set as a reference voltage $V_{ref}$ ($V_{ref}$=VDD*R2/(R2+R3)).

When an earphone plug is received in the earphone jack 11, the sixth contact 116 is connected to the fifth contact 115. So the sixth contact 116 is grounded and the voltage of the third node J3 is zero. Therefore, the voltage of the third node J3 is less than the reference voltage $V_{ref}$, and then the chipset T outputs a low level (e.g., logic 0) to the receiving terminal 17. If there is on earphone plug received in the earphone jack 11, the sixth contact 116 is disconnected from the fifth contact 115, and the reference voltage $V_{ref}$ is less than the voltage of the third node J3, and then the chipset T outputs a high level (e.g., logic 1) to the receiving terminal 17. Accordingly, the receiving terminal 17 can determine whether an earphone plug is received in the earphone jack 11 by the output voltage of the chipset T.

When the receiving terminal 17 determines that there is an earphone plug received in the earphone jack 11, the detecting terminal 13 determines the type of the earphone plug received in the earphone jack 11 according to the voltage of the first node J1. When the detecting contact 13 detects that the three pin earphone plug or the first type of four pin earphone plug is received in the earphone jack 11, the controlling contact 14 controls the switch 12 to switch to the first state. That is, the first movable contact D11 and the second movable contact D21 are respectively connected to the first fixed contact D12 and the third fixed contact D22. The three pin earphone plug and the first type of four pin earphone plug can be used by the portable electronic device 100.

When the detecting contact 13 detects that the second type of earphone plug is received in the earphone jack 11, the controlling contact 14 controls the switch 12 to switches to the second state. That is, the first movable contact D11 and the second movable contact D21 are respectively connected to the second fixed contact D13 and the fourth fixed contact D23. So the third contact portion of the second type of four pin earphone plug is grounded by the third contact 113 and the switch 12. The fourth contact portion of the second type of four pin earphone plug is connected to the audio receiving contact 15 by the fourth contact 114 and the switch 12. The second type of four pin earphone plug can be used by the portable electronic device 100.

Although certain embodiments of the present disclosure have been specifically described, the present disclosure is not to be construed as being limited thereto. Various changes or modifications may be made to the present disclosure without departing from the scope and spirit of the present disclosure.

What is claimed is:

1. A portable electronic device, comprising:

an earphone jack configured to receive different types of earphone plugs; the earphone jack including a first contact, a second contact, a third contact, a fourth contact, a fifth contact, and a sixth contact; the fifth contact being grounded;

a switch connected to the earphone jack, wherein the switch includes a first switch and a second switch; the first switch includes a first movable contact, a first fixed contact, and a second fixed contact; the second switch includes a second movable contact, a third fixed contact, and a fourth fixed contact; the first movable contact and the second movable contact are respectively connected to the fourth contact and the third contact; the first fixed contact and the fourth fixed contact are both grounded; the second fixed contact and the third fixed contact are both connected to a first power by a first resistor, and form a first node; the switch is configured to switch between a first state and a second state; in the first state, the first movable contact and the second movable contact are respectively connected to the first fixed contact and the third fixed contact, in the second state, the first movable contact and the second movable contact are respectively connected to the second fixed contact and the fourth fixed contact;

a detecting terminal connected to the first node, the detecting terminal configured to detect the type of the earphone plug received in the earphone jack; and a controlling terminal connected to the switch, wherein the controlling terminal switches the switch to either the first state or the second state according to the type of the earphone plug;

a determination circuit; wherein the determination circuit includes a chipset, a negative electrode of the chipset is connected to a second power by a second resistor, and forms a second node; the second node is grounded by a third resistor, the voltage of the second node is set as a reference voltage; a positive electrode of the chipset is connected to the first power by a fourth resistor and a fifth resistor in series, and forms a third node; the third node is connected to the sixth contact; and a receiving terminal; wherein the receiving terminal is connected to the output terminal of the chipset, and is used for determining whether the earphone plug is received in the earphone jack by the output voltage of the chipset.

2. The portable electronic device of claim 1, wherein if the voltage of the first node is less than a predetermined voltage, the detecting terminal detects that the type of earphone plug received in the earphone jack is a three pin earphone plug, and the third contact and the fourth contact are both connected to a ground point.

3. The portable electronic device of claim 2, wherein if the voltage of the first node satisfies a bias voltage range, the detecting terminal detects that the type of the earphone plug received in the earphone jack is a first type of four pin earphone plug, and the third contact and the fourth contact are respectively connected to a microphone point and the ground point.

4. The portable electronic device of claim 3, wherein if the voltage of the first node does not satisfy the bias voltage range and also not less than the predetermined voltage, the detecting terminal detects that the type of earphone plug received in the earphone jack is a second type of four pin earphone plug, and the third contact and the fourth contact are respectively connected to the ground point and the microphone point.

5. The portable electronic device of claim 3, when the detecting contact detects that the type of earphone plug received in the earphone jack is the three pin earphone plug or the first type of four pin earphone plug, the controlling contact controls the switch to switch to the first state.

6. The portable electronic device of claim 4, when the detecting contact detects that the type of earphone plug received in the earphone jack is the second type of earphone plug, the controlling contact controls the switch to switches to the second state.

7. The portable electronic device as claimed in claim 1, further including an audio processing terminal, an end of the audio processing terminal is connected to the first node, another end of the audio processing terminal is connected to an audio processing circuit of the portable electronic device for receiving audio from the earphone plug by the switch and the earphone jack, and transferring the received audio to the audio processing circuit.

8. The portable electronic device as claimed in claim 1, when an earphone plug is received in the earphone jack, the sixth contact is connected to the fifth contact, and the chipset outputs a low lever to the receiving terminal; if there is no earphone plug received in the earphone jack, the sixth contact is disconnected from the fifth contact, and the chipset outputs a high lever to the receiving terminal.

9. The portable electronic device as claimed in claim 1, wherein the positive electrode of the chipset is grounded by a capacitor.

10. A portable electronic device, comprising:

an earphone jack capable of receiving different types of earphone plugs and comprising a fifth contact and a sixth contact, the fifth contact being grounded;

a switch connected to the earphone jack, the switch capable of switching between a first state and a second state;

a detecting terminal connected to the earphone jack by the switch, the detecting terminal capable of detecting the type of the earphone plug received in the earphone jack;

a controlling terminal connected to the switch, the controlling terminal switching the switch to either the first state or the second state according to the type of the earphone plug;

a determination circuit comprising a chipset, a negative electrode of the chipset being connected to a second power by a second resistor, and forming a second node;

the second node being grounded by a third resistor, the voltage of the second node being set as a reference voltage; a positive electrode of the chipset being connected to a first power by a fourth resistor and a fifth resistor in series, and forming a third node;

the third node being connected to the sixth contact; and a receiving terminal, wherein the receiving terminal is connected to the output terminal of the chipset, and used for determining whether the earphone plug is received in the earphone jack by the output voltage of the chipset.

11. The portable electronic device as claimed in claim 10, when an earphone plug is received in the earphone jack, the sixth contact is connected to the fifth contact, and the chipset outputs a low lever to the receiving terminal; if there is no earphone plug received in the earphone jack, the sixth contact is disconnected from the fifth contact, and the chipset outputs a high lever to the receiving terminal.

12. The portable electronic device as claimed in claim 10, wherein the positive electrode of the chipset is grounded by a capacitor.

13. The portable electronic device of claim 10, wherein the switch includes a first switch and a second switch, the first switch includes a first movable contact, a first fixed contact, and a second fixed contact; the second switch includes a second movable contact, a third fixed contact, and a fourth fixed contact; in the first state, the first movable contact and the second movable contact are respectively connected to the first fixed contact and the third fixed contact, in the second state, the first movable contact and the second movable contact are respectively connected to the second fixed contact and the fourth fixed contact.

14. The portable electronic device of claim 13, wherein the earphone jack further includes a first contact, a second contact, a third contact, and a fourth contact; the first movable contact and the second movable contact are respectively connected to the fourth contact and the third contact; the first fixed contact and the fourth fixed contact are both grounded; the second fixed contact and the third fixed contact are both connected to the first power by a first resistor, and form a first node; the detecting terminal is connected to the first node.

15. The portable electronic device as claimed in claim 14, further including an audio processing terminal, an end of the audio processing terminal is connected to the first node, another end of the audio processing terminal is connected to an audio processing circuit of the portable electronic device for receiving audio from the earphone plug by the switch and the earphone jack, and transferring the received audio to the audio processing circuit.

* * * * *